US006538495B2

(12) United States Patent
Goutti et al.

(10) Patent No.: US 6,538,495 B2
(45) Date of Patent: Mar. 25, 2003

(54) PAIR OF BIPOLAR TRANSISTOR COMPLEMENTARY CURRENT SOURCES WITH BASE CURRENT COMPENSATION

(75) Inventors: Frédéric Goutti, Grenoble (FR); Jérôme Bourgoin, St. Egreve (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/010,770

(22) Filed: Dec. 6, 2001

(65) Prior Publication Data

US 2002/0089371 A1 Jul. 11, 2002

(30) Foreign Application Priority Data

Dec. 7, 2000 (FR) ..... 00 15902

(51) Int. Cl.[7] ..... G05F 3/02
(52) U.S. Cl. ..... 327/538; 323/311; 323/312
(58) Field of Search ..... 327/536, 537, 327/538, 541; 323/311, 312, 314, 315, 316

(56) References Cited

U.S. PATENT DOCUMENTS 4,523,105 A * 6/1985 Jose et al. ..... 327/104
5,512,816 A 4/1996 Lambert ..... 323/315
5,539,302 A 7/1996 Takimoto et al. ..... 323/315
5,929,678 A * 7/1999 Kasperkovitz et al. ..... 327/157
5,977,817 A 11/1999 de la Soujeole ..... 327/538
6,175,266 B1 * 1/2001 Sharpe-Geisker ..... 327/541
6,346,848 B1 * 2/2002 Shkap ..... 327/538

* cited by examiner

*Primary Examiner*—Tuan T. Lam
*Assistant Examiner*—Hiep Nguyen
(74) *Attorney, Agent, or Firm*—Allen, Dyer, Doppelt, Milbrath & Gilchrist, P.A.; Lisa K. Jorgenson

(57) ABSTRACT

A pair of complementary current sources includes a reference current source, and two complementary current mirrors having the same number of branches provided with bipolar mirror transistors. The bases of the mirror transistors of the complementary mirrors are connected to a common node. One of the complementary mirrors is connected to the reference source. An intermediate current mirror includes a first slave branch connected to the other complementary current mirror, a second slave branch connected to the reference source, and a master branch connected to the output of a trimming circuit for trimming the complementary currents for substantially equalizing the base currents of the mirror transistors of the complementary current mirrors. The input of the trimming circuit is connected to the common node.

28 Claims, 5 Drawing Sheets

PAIR OF BIPOLAR TRANSISTOR COMPLEMENTARY CURRENT SOURCES WITH BASE CURRENT COMPENSATION

FIELD OF THE INVENTION

The present invention relates to electronics, and more particularly, to a pair of complementary current sources.

BACKGROUND OF THE INVENTION

FIG. 1 illustrates a pair of complementary current sources of a known type. The pair of current sources includes a reference current source I1 and three current mirrors M1, M2 and M3. The pair of complementary current sources is such that the sum of complementary currents is substantially equal to the current of the reference source. The pair of complementary current sources is connected between two supply terminals 7 and 8. The first supply terminal 7 is set to a high potential Vcc, and the second supply terminal 8 is set to a low potential Vee, which is generally ground.

In the example, the reference current source I1 is connected between supply terminal 7 set to a high potential Vcc, and to the first current mirror M1 and to the second current mirror M2. The current source I1 delivers a current Iref, and is relatively straightforward to make.

The first current mirror M1 includes a master branch 1 with a diode connected bipolar mirror transistor T1, and a slave branch 2 with a bipolar mirror transistor T2. It is assumed that both transistors T1, T2 are of the NPN type. The bases of both transistors T1, T2 are connected together, and the emitters of both transistors T1, T2 are connected to the supply terminal 8 set to a low potential Vee. The collector of transistor T1 is connected to the base thereof, and to the reference current source I1. The collector of transistor T2 supplies an incoming current IN.

The second current mirror M2 includes a master branch 3 with a diode connected bipolar mirror transistor T3, and a slave branch 4 with a bipolar mirror transistor T4. It is assumed that both transistors T3, T4 are of the NPN type. The bases of both transistors T3, T4 are connected together, and the emitters of both transistors T3, T4 are connected to the supply terminal 8 set to the low potential Vee. The collector of transistor T3 is connected to the base thereof, and to the reference current source I1. The collector of transistor T4 is connected to the third current mirror M3.

The third current mirror M3 includes a master branch 5 with a diode connected bipolar mirror transistor T5, and a slave branch 6 with a bipolar mirror transistor T6. It is assumed that both transistors T5, T6 are of the PNP type. The third mirror is complementary to the first one M1.

The bases of both transistors T5, T6 are connected together, and the emitters of both transistors T5, T6 are connected to the supply terminal 7 set to the high potential Vcc. The collector of transistor T5 is connected to the base thereof, and to the collector of transistor T4 of the second current mirror M2. The collector of transistor T6 supplies an outgoing current IP.

As a result of such a current mirror arrangement, current Iref of the current source I1 is substantially the sum of the incoming IN and outgoing IP currents. Each of the sources of the pair is to bias complementary transistors. These transistors are made at the same time as those of the current mirrors of the source pair. Identical bipolar transistors of the same type, e.g., NPN, thus have identical features and in particular the same current gain $\beta_N$. However, the current gains $\beta_N$ and $\beta_P$ of the two complementary transistors are not equal.

For some applications, in particular rail-to-rail long-tail pair connections, the bases of both complementary transistors NPN and PNP are connected together and set to the same potential. To improve accuracy and obtain reduced offset voltage, it is desired to cancel the base current of the NPN transistor through the base current of the PNP transistor, i.e., the quantity $IN/\beta_N$ is to be substantially equal to the quantity $IP/\beta_P$. This is not possible with a pair of current sources as illustrated in FIG. 1.

SUMMARY OF THE INVENTION

In view of the foregoing background, an object of the present invention is to provide a pair of complementary current sources, with one current source for biasing at least one transistor and the other current source for biasing at least one transistor of a complementary type.

This and other objects, advantages and features according to the present invention are provided by a pair of complementary sources formed by a reference current source, and two complementary current mirrors having complementary bipolar transistors. The complementary transistors supply the complementary currents so that the sum of the complementary currents is substantially equal to the reference current of the reference current source, and so that the base currents of the complementary transistors compensate for each other.

Thus, when using such a pair of complementary sources for biasing complementary bipolar transistors, their base currents will compensate for each other. For this purpose, the pair of complementary current sources comprises a reference current source, and two complementary current mirrors each having a master branch and at least one slave branch. Each branch is provided with a bipolar mirror transistor, and the bases of the mirror transistors of the same mirror are connected together. These complementary current mirrors deliver complementary currents at respective slave branches. The first one of the complementary current mirrors is connected to the reference current source via the master branch thereof.

The pair of complementary current sources further includes an intermediate current mirror having a master branch and at least one slave branch connected to the master branch of the second one of the complementary current mirrors via the slave branch thereof.

The pair of complementary current sources further includes means for mutually trimming the complementary currents. The trimming means is connected between the master branch of the intermediate current mirror and a node common to the bases of the mirror transistors of the complementary current mirrors. This substantially equalizes the base currents of the mirror transistors of the complementary mirrors. The intermediate current mirror is connected to the reference current source via a second slave branch.

The difference between the number of branches of the complementary current mirrors is chosen to be less than or equal to one so that, when the complementary currents are trimmed, the common node is equal to the sum of currents substantially canceled by the effect of the trimming means.

The trimming means of the complementary currents can be made from a common-emitter amplifying transistor, the base of which is connected to the common node. In this configuration, the first one of the complementary current mirrors has one slave branch more than the second one of the complementary current mirrors. The transistor of the trimming means is then of the same type as the mirror transistors of the second one of the complementary current mirrors.

The mirror transistor of the master branch of at least one of the complementary current mirrors can be diode-connected via an additional transistor, with the mirror transistor and the additional transistor having a cascode arrangement. In this configuration, the base of the mirror transistors of at least one of the complementary current mirrors is connected to the common node via the additional transistor. Voltage down-converting means may also be series-connected with the transistor of the trimming means on the emitter-side thereof.

Another aspect of the invention is directed to an integrated circuit comprising complementary transistors and a pair of complementary current sources for biasing the complementary transistors. Such current source pairs are frequently used in the input stages of operational amplifiers and inside comparators.

BRIEF DESCRIPTION OF THE DRAWINGS

Other features and advantages of the invention will be apparent from reading the following description, which is illustrated by the figures of the appended drawings. This description is given by way of example only and is not to be restrictive.

DETAILED DESCRIPTION OF THE PREFERRED EMBODIMENTS

Figure 1:
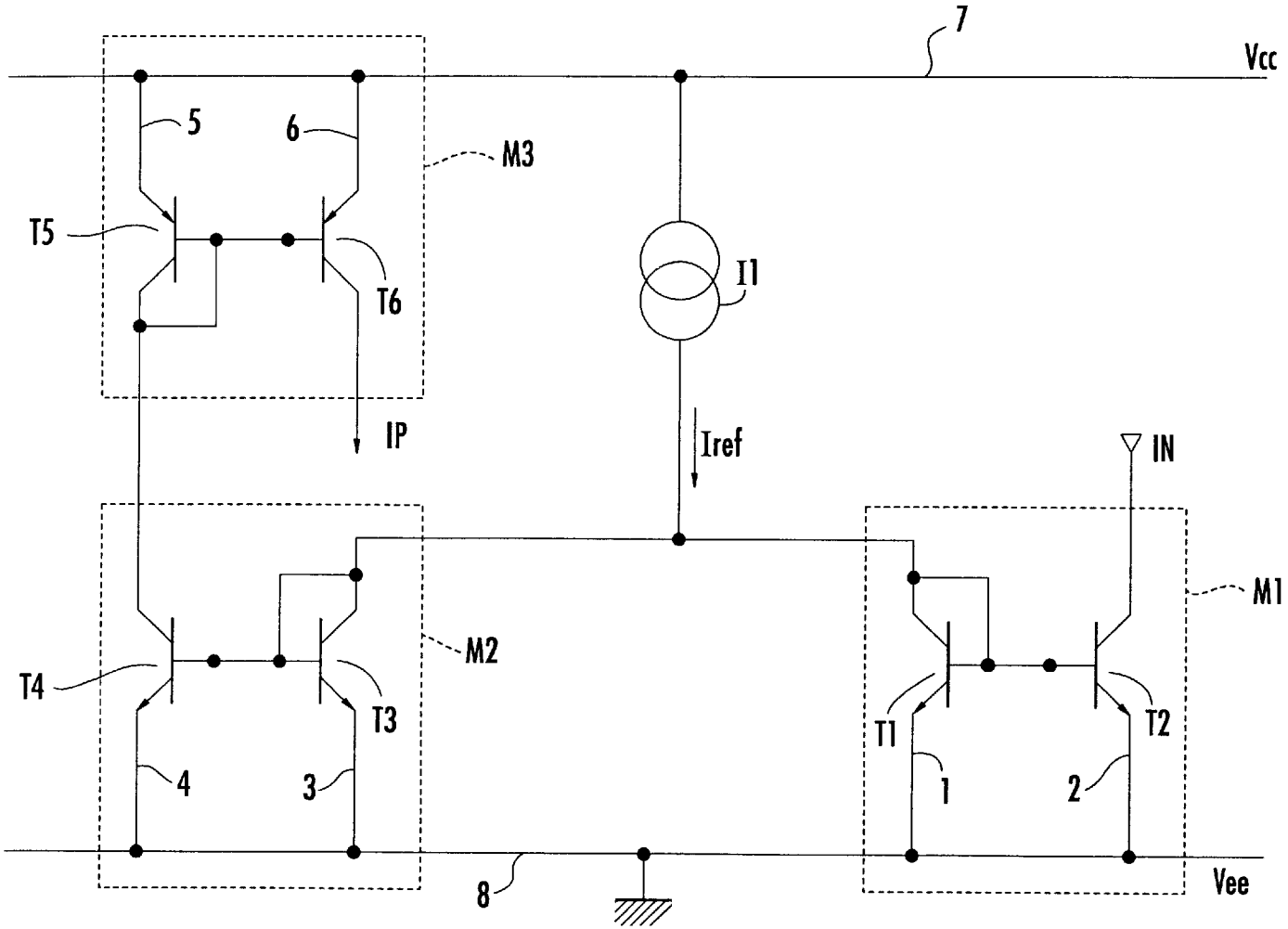
FIG. 1. PRIOR ART
FIG. 1 is a circuit diagram of a pair of complementary current sources according to the prior art.
Figure 2A:
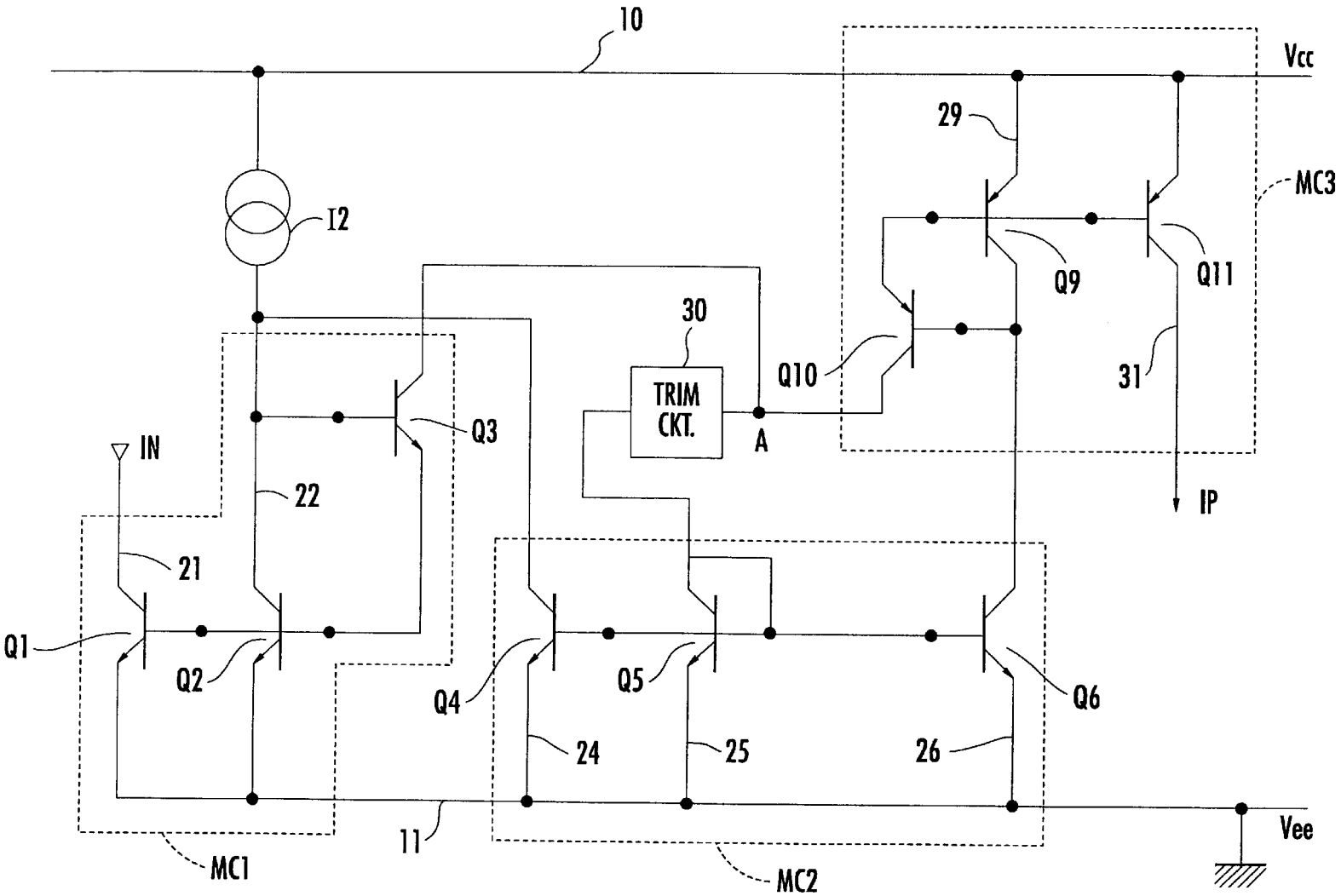
FIG. 2A is a circuit diagram of a sample pair of complementary current sources in accordance with the invention.

Referring now to FIG. 2A, the pair of complementary current sources according to the invention is connected between two supply terminals 10 and 11. One terminal 10 is set to a high potential Vcc and the other terminal 11 is set to a low potential Vee, which is generally ground. The pair of complementary current sources has a reference current source I2 and three current mirrors MC1, MC2 and MC3 with bipolar mirror transistors.

Among these current mirrors MC1, MC2, MC3, two MC1, MC3 are complementary and the third one MC2 is an intermediate one. One of the complementary current mirrors MC1, composed of bipolar NPN transistors, supplies one of the complementary currents IN, and the other current mirror MC3, composed of bipolar PNP transistors, supplies the other complementary current IP. One of the complementary currents IN is incoming and the other one IP is outgoing. Each current mirror could be replaced with its complementary mirror by appropriately modifying their connections and without departing from the scope of the invention.

Reference current source I2 is connected between one of the supply terminals 10 (e.g., Vcc) and a first end of a master branch 22 of the first one of the complementary current mirrors MC1. The other end of the master branch 22 is connected to the other supply terminal 11 (e.g., Vee). In the master branch 22, one of the complementary currents is conducting, which is the incoming current IN in the example.

The first one of the complementary current mirrors MC1 has at least one slave branch 21, wherein the same current is conducting as in the master branch 22. In FIG. 2A, the current mirror MC1 has only one slave branch 21. One end of this slave branch 21 is connected to the supply terminal 11 set to the low potential Vee, and the other end is to be connected to a circuit (not shown), to be biased by the pair of complementary current sources. The master branch 22 includes a diode-connected mirror transistor Q2. The emitter thereof is connected to the supply terminal 11 set to the low potential Vee. The collector thereof is connected to the reference source I2. The base thereof is connected to the associated collector.

The slave branch 21 includes a mirror transistor Q1, the emitter of which is connected to the supply terminal 11. The collector is connected to the circuit to be biased, and the base is connected to the base of transistor Q2 of master branch 22.

The second complementary current mirror MC3 includes a master branch 29 and at least one slave branch 31. The master branch 29 is connected between the supply terminal 10 set to the high potential Vcc and the intermediate current mirror MC2. The slave current branch 31 is connected between the supply terminal 10 and the circuit to be biased (not shown).

The master branch 29 comprises a diode-connected mirror transistor Q9. The emitter thereof is connected to supply terminal 10 set to the high potential Vcc. The collector thereof is connected to the intermediate current mirror MC2. The base thereof is connected to the associated collector.

The slave branch 31 comprises a mirror transistor Q11, the emitter of which is connected to the supply terminal 10. The collector is connected to the circuit to be biased, and the base is connected to the base of transistor Q9 of the master branch 29.

In the example, the intermediate current mirror MC2 is made from bipolar transistors of the NPN type. The intermediate current mirror MC2 comprises a master branch 25 and two slave branches 24, 26. One of the slave branches 24 is connected between reference current source I2 and the supply terminal 11 is set to the low potential Vee. The other slave branch 26 is connected between the master branch 29 of the second one of the complementary current mirrors MC3 and the supply terminal 11.

Master branch 25 is connected between the supply terminal 11 and the output of the means 30 for trimming the complementary currents IN, IP. The trimming means 30 enables compensation of the base currents of the complementary transistors of the complementary current mirrors. When the trimming is performed, the base currents of the complementary transistors of the complementary current mirrors are substantially equal.

The input of the trimming means 30 is connected to a node A common to the bases of transistors Q1, Q2 of the first one of the complementary current mirrors MC1, and to the bases of transistors Q9, Q11 of the second one of the complementary current mirrors MC3.

Master branch 25 comprises a diode-connected mirror transistor Q5, the emitter of which is connected to the supply terminal 11 set to the low potential Vee. The collector is connected to the output of the trimming means 30, and the base is connected to the associated collector.

The first slave branch 24 comprises a mirror transistor Q4, the emitter of which is connected to the supply terminal 11. The collector is connected to the reference current source I2, and the base is connected to the base of transistor Q5 of the master branch 25. The second slave branch 26 comprises a mirror transistor Q6, the emitter of which is connected to supply terminal 11. The collector is connected to the collector of transistor Q9 of the master branch 29 of the second one of the complementary current mirrors MC3, and the base is connected to the base of transistor Q5 of the master branch 25.

The trimming means 30 applies the mirror current that will flow in the master branch 25 of the intermediate mirror MC2. It has the function of an amplifier, the input of which is connected to node A and the output of which is connected to the master branch of the intermediate current mirror MC2.

At node A, there is the sum of the base currents of mirror transistors Q1, Q2 of the first one of the complementary current mirrors MC1, and the sum of the base currents of mirror transistors Q9, Q11 of the second one of complementary current mirrors MC3. In this example, the two complementary current mirrors MC1 and MC2 have the same number of branches.

The trimming means 30 has an effect on the complementary current IP delivered by the second one of the complementary current mirrors MC3 via the mirror current of intermediate mirror MC2. When the complementary current IP increases, the other complementary current IN decreases, and vice versa.

The bases of the mirror transistors Q2, Q9 of the master branches 22, 29 of the complementary current mirrors MC1, MC3 cannot be connected directly to their collectors. This link is made through an additional transistor, respectively Q3 and Q10. A mirror transistor and an associated additional transistor are in a cascode arrangement. This arrangement avoids operating interferences.

The bases of these additional transistors Q3 and Q10 are connected respectively to the collectors of transistors Q2, Q9. The collectors thereof are connected respectively to the bases of transistors Q2, Q9, and the emitters are connected together forming node A.

The operation of this pair of complementary current sources will now be described. The current IN conducting through the master branch 22 of the first one of the complementary current mirrors MC1 confirms the following relation: IN≈Iref−IQ4. Iref is the current of the reference current source I2, and IQ4 is the current flowing in the slave branch 24 of intermediate current mirror MC2. The current base of transistor Q3 is negligible in comparison with Iref.

The current IN also flows in the slave branch 21 of the first one of the complementary current mirrors MC1. This current can thus be used by a circuit to be biased by the pair of complementary current sources. The current IQ4 flowing in the slave branch 24 of the intermediate current mirror MC2 is determined by the current flowing in the master branch 25 of intermediate current mirror MC2. This current 1Q4 is also present in the slave branch 26 of the intermediate current mirror MC2.

The current in the master branch 29 of the second one of the complementary current mirrors MC3 is substantially equal to the current IQ4. The base current of transistor Q10 is negligible in comparison with IQ4. This current IQ4 is replicated in the slave branch 31 of the second one of the complementary current mirrors MC3. This current IQ4 is the current IP, complementary to the current IN, and is delivered by the pair of complementary current sources.

The equation 1 defined as Iref≈IN+IP thus actually holds true. At node A, the base currents of the mirror transistors Q9, Q11 of the second one of the complementary current mirrors MC3, i.e., $2IP/\beta_P$, and the base currents of the mirror transistors Q1, Q2 of the first one of the complementary current mirrors MC1, i.e., $2IN/\beta_N$, are summed.

If $2IP/\beta_P > 2IN/\beta_N$, the trimming means 30 reduces the current in the master branch 25 of the intermediate current mirror MC2. The current IP decreases and the current IN increases until the balance $2IP/\beta_P \approx 2IN/\beta_N$ is achieved. On the contrary, if $2IP/\beta_P < 2IN/\beta_N$, the trimming means 30 increases the current in the master branch 25 of the intermediate current mirror MC2. The current IP increases and the current IN decreases until the balance $2IP/\beta_P \approx 2IN/\beta_N$ is achieved. In the case of being balanced, $IP/\beta_P \approx IN/\beta_N$ (equation 2) will actually be obtained at the complementary transistors biased by the pair of complementary current sources.

Figure 2B:
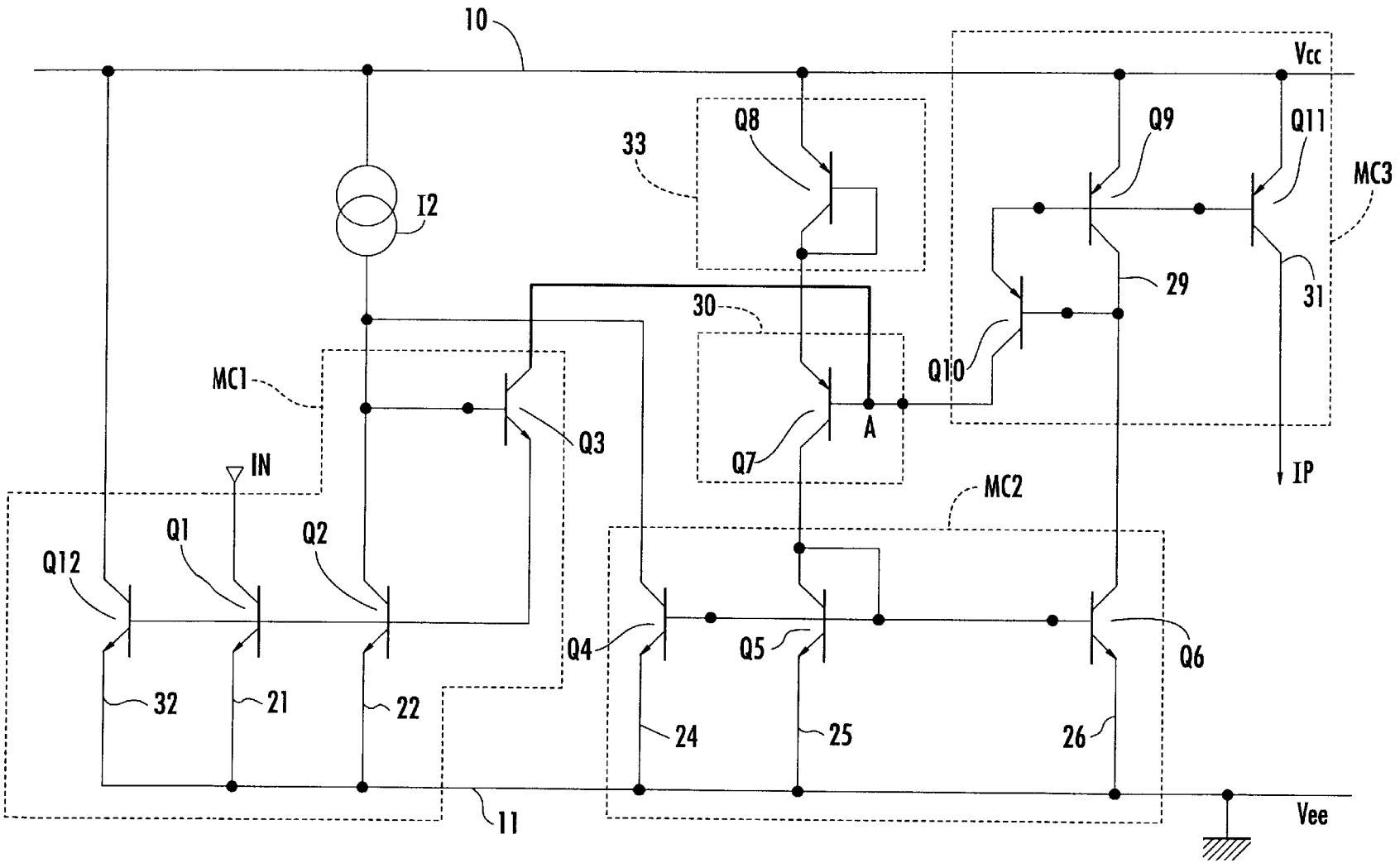
FIG. 2B is a similar circuit diagram with a specific embodiment of the trimming means.

The trimming means 30 is chosen to obtain an input offset voltage as low as possible so that it can be neglected so as not to distort the trimming of the currents IN and IP. FIG. 2B shows an illustrative embodiment of the trimming means 30. In comparison with FIG. 2A, it appears that the first one of the complementary current mirrors MC1 comprises an additional slave branch 32. This is a balancing slave branch connected between the two supply terminals 10, 11. The balancing slave branch 32 comprises a mirror transistor Q12, the emitter of which is connected to supply terminal 11. The collector is connected to the other supply terminal 10, and the base is connected to the base of transistor Q2 of the master branch 22.

In the illustrative embodiment described, the trimming means 30 is achieved through a common-emitter bipolar amplifying transistor Q7. More precisely, the transistor is of the same type as the mirror transistors of the second one of the current mirrors MC3. In the example described, the transistor is a PNP transistor, the base of which is connected to node A. The collector is connected to the collector of transistor Q5 of the master branch 25 of the intermediate current mirror MC2, and the emitter is connected to the supply terminal 10 set to the high potential. In this embodiment, there is no offset voltage at the input which might distort trimming.

As the trimming transistor Q7 is connected to the master branch 25 of the intermediate current mirror MC2, the collector current IQ7 thereof is substantially equal to the current IP. In this embodiment, at node A, there is the sum of the base currents of the mirror transistors Q1, Q2, Q12 of the first one of the complementary current mirrors MC1, i.e., $3IN/\beta_N$, and the sum of the base currents of the mirror transistors Q9, Q11 of the second one of the complementary current mirrors MC3 and of the base current of the trimming transistor Q7, i.e., $3IP/\beta_P$. Any unbalance between these quantities varies the collector current IQ7 of transistor Q7, i.e., IP, so as to reach the required balance. The difference between the number of branches of the complementary current mirrors is less than or equal to one.

The trimming transistor Q7 amplifies the differences of the base currents of the mirror transistors of the complementary mirrors so as to reach the desired balance. The emitter of transistor Q7 cannot be connected directly to the supply terminal 10 set to the high potential Vcc, otherwise, there is a risk of the transistor Q10 being saturated. Voltage down-converting means 33 is inserted between the supply terminal 10 and the emitter of transistor Q7. This circuit generates a potential drop between the potential Vee and the potential of the emitter of transistor Q7. The voltage down-converting means 33 may be achieved through a simple resistor, a diode or a diode-connected transistor Q8 as illustrated in FIG. 2B. The collector thereof is connected to supply terminal 10, the emitter is connected to the emitter of transistor Q7, and the base is connected to the associated emitter.

Adding further additional slave branches in the two complementary current mirrors MC1, MC3 can be done if required, but these mirrors must keep an adequate number of branches so that trimming can be performed. The configuration of the trimming means described with a bipolar transistor is particularly straightforward. Other configurations are possible with several bipolar transistors or with one or more MOS transistors.

Figure 3A:
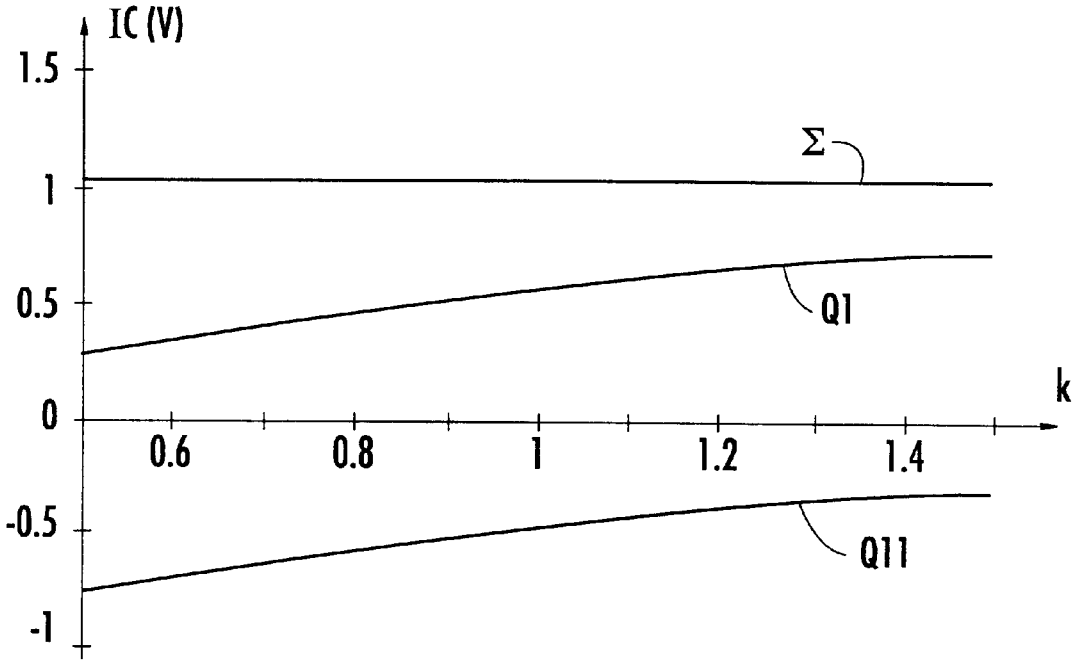
FIG. 3A is a representation of the variations of the collector current of the transistors of the slave branches of the two complementary current mirrors when their current gain $\beta_N$ and $\beta_P$ varies in an inverse proportion according to the invention.
Figure 3B:
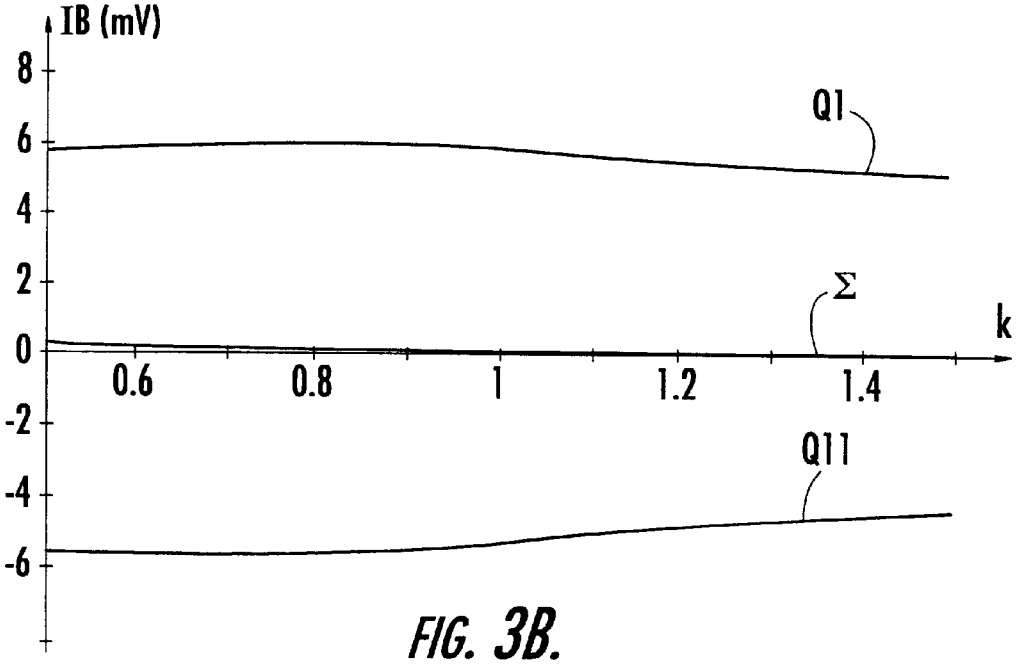
FIG. 3B is a representation of the variations of the base current of the transistors of the slave branches of the two complementary current mirrors when their current gain $\beta_N$ and $\beta_P$ varies in an inverse proportion according to the invention.

FIGS. 3A and 3B are graphs illustrating the variations of the collector currents IC and the base currents IB of the transistors Q1 and Q11 which are complementary when the gain $\beta_N$ and $\beta_P$ varies in an inverse proportion. In these graphs, the x-axis is a parameter k, such as $\beta_P=\beta_{P\ name}/k$ and $\beta_N=\beta_{P\ name}\times k$, with $\beta_{P\ name}$ and $\beta_{N\ name}$ being a nominal current gain. The sum of the collector currents and the sum of the base currents are represented, and they are substantially constant so that the two equations hold true.

Figure 4:
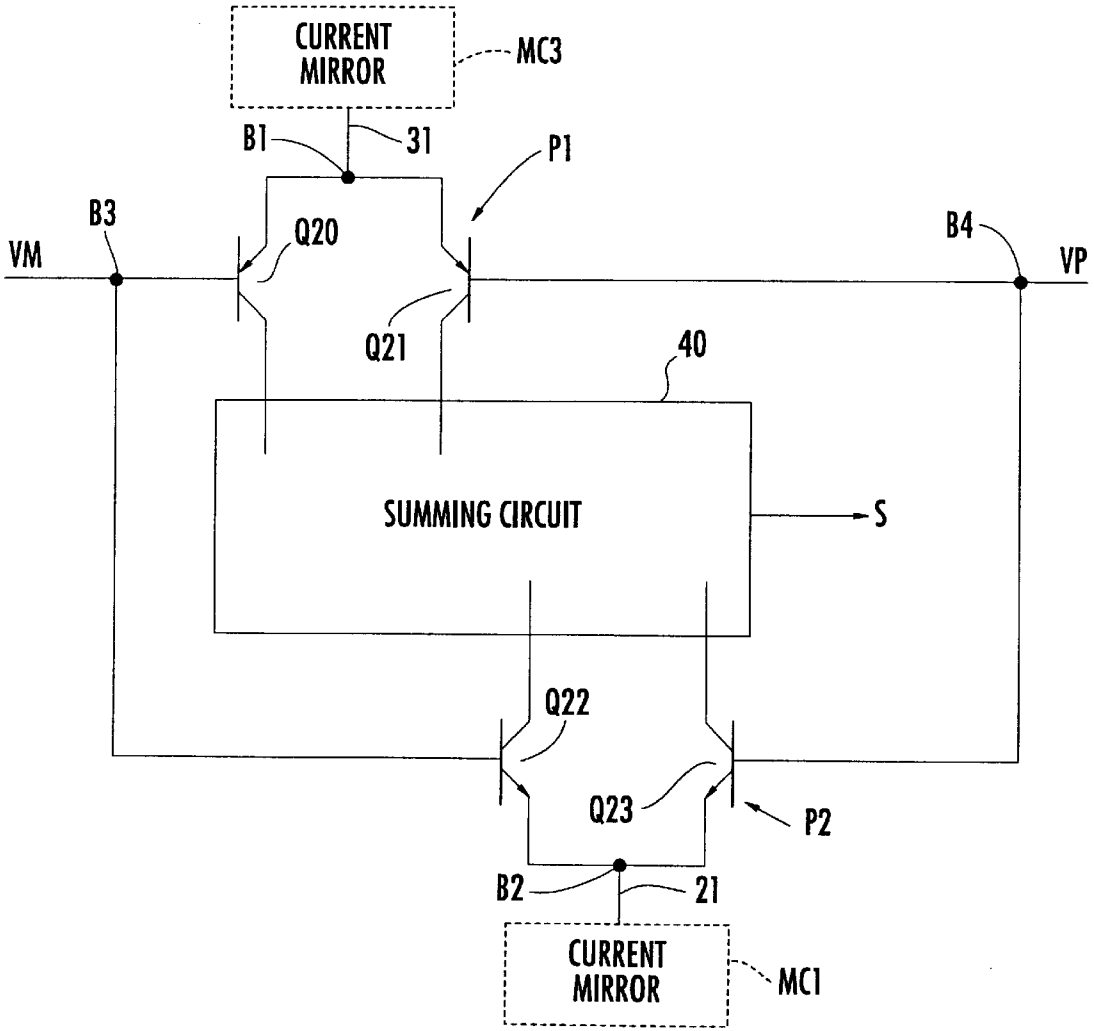
FIG. 4 is a circuit diagram of an integrated circuit comprising the pair of complementary current sources according to the invention.

FIG. 4 illustrates a circuit diagram of a sample integrated circuit with a pair of complementary current sources in accordance with the invention, and the transistors to be biased. The pair of current sources is only represented in part by the two complementary current mirrors MC1 and MC3.

The represented circuit comprises two long-tail pairs of transistors P1, P2 in a rail-to-rail arrangement. The first long-tail pair P1 comprises two bipolar transistors Q20, Q21 of the same type, which are PNP in the example. The emitters are connected at a common point B1, the bases are set respectively to voltage VM and VP, and the collectors are connected to the input of the summing means 40.

The second long-tail pair P2 comprises two bipolar transistors Q22, Q23 of the same type, which are NPN in the example. The emitters are connected at a common point B2, the bases are set respectively to voltage VM and VP, and the collectors are connected to the input of the summing means 40.

The bases of the transistors Q20, Q22 are connected to a common point B3 set to potential VM, and the bases of transistors Q21, Q23 are connected at a common point B4 set to potential VP. The output current S of the summing means 40 is the sum (in absolute value) of the collector currents of transistors Q20, Q21, Q22, Q23 of the two long-tail pairs.

The slave branch 21 of the first one of the complementary current mirrors MC1 is connected to the common point B2, and the slave branch 31 of the second one of the complementary current mirrors MC3 is connected to the common point B2. Transistors Q20, Q21 are the same as transistors Q7, Q9, Q11. They have the same current gain $\beta_P$. Similarly, transistors Q22, Q23 are the same as transistors Q1, Q2, Q12, and they have the same current gain $\beta_N$.

To improve accuracy in this type of circuit, the base current Ibp of transistors Q20, Q21 are compensated through the base current Ibn of transistors Q22, Q23 to substantially cancel the currents two by two at the common points B3, B4. If Ibn≈Ibp (equation 3), the currents at points B3 and B4 are canceled.

Current Ibn can be expressed as follows: $Ibn=Icn/\beta_N$ and $Ibn\approx IN/2\beta_N$, with Icn being the collector current of transistors Q22 and Q23. Current Ibp can be expressed as follows: $Ibp=Icp/\beta_P$ and $Ibp\approx IP/2\beta_P$, with Icp being the collector current of transistors Q20 and Q21. Since the currents IN and IP are the currents delivered by the pair of complementary current sources, they are related as follows: $IP/\beta_P\approx IN/\beta_N$ (equation 2). It is deduced therefrom that equation 3 holds true.

The represented circuit diagrams may be replaced by their complements by inverting currents and voltages.

That which is claimed is:

1. A circuit generating complementary currents comprising:

a reference current source;

first and second complementary current mirrors connected to said reference current source, each current mirror comprising a master branch comprising a bipolar mirror transistor having a base, and at least one slave branch comprising a bipolar mirror transistor having a base connected to the base of said bipolar mirror transistor in the master branch, said first and second complementary current mirrors delivering the complementary currents at the respective slave branches, with said first complementary current mirror being connected to said reference current source via the master branch thereof;

an intermediate current mirror comprising a master branch, a first slave branch connected to the master branch of said second complementary current mirrors, and a second slave branch connected to said reference current source; and a trimming circuit for mutually trimming the complementary currents by substantially equalizing base currents of said bipolar mirror transistors of said first and second complementary current mirrors, said trimming circuit being connected between the master branch of said intermediate current mirror and a common node common to the bases of said bipolar mirror transistors of said first and second complementary current mirrors.

2. A circuit according to claim 1, wherein a difference between a number of branches of said first and second complementary current mirrors is less than or equal to one so that, when the complementary currents are trimmed, the common node has a sum of currents substantially canceled by said trimming circuit.

3. A circuit according to claim 1, wherein said trimming circuit comprises a common-emitter amplifying transistor having a base connected to the common node.

4. A circuit according to claim 3, wherein said common-emitter amplifying transistor is of a same type as said bipolar mirror transistors of said second complementary current mirror.

5. A circuit according to claim 1, wherein said first complementary current mirror comprises one more slave branch than said second complementary current mirror.

6. A circuit according to claim 1, wherein at least one of said first and second complementary current mirrors further comprises an additional transistor, and wherein said bipolar mirror transistor of the master branch therein is diode-connected via said additional transistor, with said bipolar mirror transistor and said additional transistor having a cascode arrangement.

7. A circuit according to claim 6, wherein the bases of said bipolar mirror transistors of at least one of said first and second complementary current mirrors are connected to the common node via said additional transistor.

8. A circuit according to claim 3, further comprising a voltage down-converter series-connected with an emitter of said transistor of said trimming circuit.

9. A circuit generating complementary currents comprising:

a reference current source;

first and second complementary current mirrors connected to said reference current source for delivering complementary currents at the respective current mirrors, each current mirror comprising a plurality of mirror transistors;

an intermediate current mirror connected to said reference current source and to said second complementary current mirrors; and a trimming circuit for mutually trimming the complementary currents by substantially equalizing control terminal currents of said mirror transistors of said first and second complementary current mirrors, said trimming circuit being connected between said intermediate current mirror and a common node common to the control terminals of said mirror transistors of said first and second complementary current mirrors.

10. A circuit according to claim 9, wherein each mirror transistor comprises a bipolar transistor.

11. A circuit according to claim 9, wherein each current mirror comprises:

a master branch including one of said plurality of mirror transistors; and at least one slave branch including another one of said plurality of mirror transistors, each mirror transistor having a control terminal connected to the control terminal of the other mirror transistor;

said first and second complementary current mirrors delivering the complementary currents at the respective slave branches.

12. A circuit according to claim 9, wherein said intermediate current mirror comprises a master branch, a first slave branch connected to the master branch of said second complementary current mirror, and a second slave branch connected to said reference current source.

13. A circuit according to claim 12, wherein said trimming circuit is connected between the master branch of said intermediate current mirror and the common node.

14. A circuit according to claim 9, wherein a difference between a number of branches of said first and second complementary current mirrors is less than or equal to one so that, when the complementary currents are trimmed, the common node has a sum of currents substantially canceled by said trimming circuit.

15. A circuit according to claim 10, wherein said first complementary current mirror comprises one more slave branch than said second complementary current mirror.

16. A circuit according to claim 9, further comprising a voltage down-converter connected to said trimming circuit.

17. An integrated circuit comprising:

first and second pairs of complementary transistors; and a circuit generating complementary currents for biasing said first and second pairs of complementary transistors and comprising a reference current source, first and second complementary current mirrors connected to said reference current source for delivering the complementary currents at the respective current mirrors, each current mirror comprising a plurality of mirror transistors, an intermediate current mirror connected to said reference current source and to said second complementary current mirrors, and a trimming circuit for mutually trimming the complementary currents by substantially equalizing control terminal currents of said mirror transistors of said first and second complementary current mirrors, said trimming circuit being connected between said intermediate current mirror and a common node common to the control terminals of said mirror transistors of said first and second complementary current mirrors.

18. An integrated circuit according to claim 17, wherein each mirror transistor and each transistor of said first and second pairs of complementary transistors comprises a bipolar transistor.

19. An integrated circuit according to claim 17, wherein each current mirror comprises:

a master branch including one of said plurality of mirror transistors; and at least one slave branch including another one of said plurality of mirror transistors, each mirror transistor having a control terminal connected to the control terminal of the other mirror transistor;

said first and second complementary current mirrors delivering the complementary currents at the respective slave branches.

20. An integrated circuit according to claim 17, wherein said intermediate current mirror comprises a master branch, a first slave branch connected to the master branch of said second complementary current mirror, and a second slave branch connected to said reference current source.

21. An integrated circuit according to claim 20, wherein said trimming circuit is connected between the master branch of said intermediate current mirror and the common node.

22. An integrated circuit according to claim 17, wherein a difference between a number of branches of said first and second complementary current mirrors is less than or equal to one so that, when the complementary currents are trimmed, the common node has a sum of currents substantially canceled by said trimming circuit.

23. An integrated circuit according to claim 17, wherein said trimming circuit comprises a transistor having a control terminal connected to the common node.

24. An integrated circuit according to claim 17, further comprising a voltage down-converter connected to said trimming circuit.

25. A method for biasing first and second pairs of complementary transistors using first and second complementary current mirrors connected to a reference current source, and each current mirror comprising a plurality of mirror transistors, the method comprising:

delivering complementary currents at the respective current mirrors for the first and second pairs of complementary transistors; and mutually trimming the complementary currents using a trimming circuit by substantially equalizing control terminal currents of the mirror transistors of the first and second complementary current mirrors, the trimming circuit being connected between an intermediate current mirror and a common node common to the control terminals of the mirror transistors of the first and second complementary current mirrors.

26. A method according to claim 25, wherein each current mirror comprises a master branch including one of the plurality of mirror transistors; and at least one slave branch including another one of the plurality of mirror transistors, each mirror transistor having a control terminal connected to the control terminal of the other mirror transistor; and wherein the complementary currents are delivered at the respective slave branches of the first and second complementary current mirrors.

27. A method according to claim 25, wherein the intermediate current mirror comprises a master branch, a first slave branch connected to the master branch of the second complementary current mirror, and a second slave branch connected to the reference current source.

28. A method according to claim 25, wherein a difference between a number of branches of the first and second complementary current mirrors is less than or equal to one so that, when the complementary currents are trimmed, the common node has a sum of currents substantially canceled by the trimming circuit.

* * * * *